United States Patent [19]

Oloman et al.

[11] Patent Number: 5,074,975

[45] Date of Patent: Dec. 24, 1991

[54] ELECTROCHEMICAL COGENERATION OF ALKALI METAL HALATE AND ALKALINE PEROXIDE SOLUTIONS

[75] Inventors: Colin W. Oloman, Vancouver, Canada; Eric Kalu, College Station, Tex.

[73] Assignee: The University of British Columbia, Vancouver, Canada

[21] Appl. No.: 564,730

[22] Filed: Aug. 8, 1990

[51] Int. Cl.[5] ..... C25B 1/24; C25B 1/30

[52] U.S. Cl. ..... 204/82; 204/83; 204/95

[58] Field of Search ..... 204/82, 83, 95

[56] References Cited

U.S. PATENT DOCUMENTS

| | | | |
|---|---|---|---|
| 2,000,815 | 5/1935 | Berl | 204/84 |
| 3,454,477 | 7/1969 | Grangaard | 204/84 |
| 3,681,213 | 4/1972 | Heit et al. | 204/82 |
| 3,884,777 | 5/1975 | Harke et al. | 204/84 |
| 3,969,201 | 7/1976 | Oloman et al. | 204/83 |
| 4,067,787 | 1/1978 | Kastening et al. | 204/84 |
| 4,118,305 | 10/1978 | Oloman et al. | 204/82 |
| 4,406,758 | 9/1983 | McIntyre et al. | 204/98 |

FOREIGN PATENT DOCUMENTS 61-284591 12/1986 Japan .

99L079 5/1965 United Kingdom .

OTHER PUBLICATIONS

J. E. Colman, "Electrolytic production of sodium chlorate", AIChE Symposium 204, vol. 77, 1981, pp. 244–263.

E. Berl, "A new cathodic process for the production of $H_2O_2$", Seventy-sixth General meeting , N.Y., N.Y., Sep. 11, 1938, H. S. Lukens presiding.

*Primary Examiner*—John Niebling
*Assistant Examiner*—David G. Ryser
*Attorney, Agent, or Firm*—Barrigar & Oyen

[57] ABSTRACT

This invention relates to a process and apparatus for the electrosynthesis of oxygenated halogen salts of alkali metals such as alkali metal halate, alkali metal hypohalite and alkali metal perhalate and an alkaline solution of hydrogen peroxide in the same electrochemical reactor. The invention also relates to a method for oxygen depolarization of cathodes in reactors that are used for the electrosynthesis of oxygenated halogen salts of alkali metals. The invention also relates to a method for the electrosynthesis of oxygenated chlorine salts of alkali metals which avoids the need to use chromates that are used in conventional chlorate production for the suppression of the cathodic reduction of hypochlorite.

8 Claims, 2 Drawing Sheets

ELECTROCHEMICAL COGENERATION OF ALKALI METAL HALATE AND ALKALINE PEROXIDE SOLUTIONS

FIELD OF THE INVENTION

This invention relates to a process and apparatus for the electrosynthesis of oxygenated halogen salts of alkali metals such as alkali metal hypohalite, alkali metal halate and alkali metal perhalate and an alkaline solution of hydrogen peroxide in the same electrochemical reactor. The invention also relates to a method for oxygen depolarisation of cathodes in reactors that are used for the electrosynthesis of oxygenated halogen salts of alkali metals. The invention also relates to a method for the electrosynthesis of oxygenated chorine salts of alkali metals which avoids the need to use chromates that are used in conventional chlorate production for the suppression of the cathodic reduction of hypochlorite.

BACKGROUND OF THE INVENTION

The electrosyntheses of oxygenated halogen salts of alkali metals and of alkaline peroxide in separate processes and reactors are well known.

For example, conventional chlorate technology is described by J. Coleman in 'Electrolytic production of sodium chlorate' A.I.Ch.E. Symposium 204 vol 77 1981. pp 244–263. With minor variations sodium chlorate is produced by electrolysis of aqueous sodium chloride solutions is undivided electrochemical cells. Chlorine is generated at the anode while hydrogen and hydroxyl ions are produced at the cathode of the chlorate cells. The chlorine is hydrolysed to hypochlorite which is converted to chlorate by a homogeneous chemical reaction. The homogeneous reaction to chlorate usually takes place in an external thermochemical reactor. The typical commercial electrosynthesis of sodium chlorate uses saturated solutions of salt at 60 to 80° C. with a chlorine anode operated at current density from 1 to 3 kA/m2. Chromates are usually added to the electrolyte. to suppress the loss of efficiency due to cathodic reduction of hypochlorite.

The electrosynthesis of alkaline peroxide solutions by reduction of oxygen in aqueous alkaline solution is described by Berl in U.S. Pat. No. 2,000,815 and by Grangaard in U.S. Pat. No. 3,454,477. Oloman and Watkinson in U.S. Pat. Nos. 3,969,201 and 4,118,305 describe a trickle bed reactor for electroreduction of oxygen to alkaline peroxide and a variation of this method is described by Mcintyre et al in U.S. Pat. No. 4,406,758. This peroxide process is not in commercial use. The process involves the electroreduction of oxygen on a three dimensional graphite cathode in aqueous sodium hydroxide. Typical conditions are a sodium hydroxide concentration from 1 to 3 molar, temperature from 20 to 30° C. and superficial cathode current density from 0.1 to 1 kA/m2. Oxygen gas is delivered to the reactor and superatmospheric oxygen pressure may be used to raise the space time yield of peroxide.

The simultaneous electrosynthesis of two useful products in the same electrochemical cell (one at the anode and one at the cathode) is well known. Hydrogen and oxygen are cogenerated by electrolysis of water in cells where the anode and cathode chambers are separated by a porous diaphragm. Chlorine and sodium hydroxide are cogenerated by electrolysis of sodium chloride in cells divided by cation membranes or porous diaphragms.

The simultaneous electrosynthesis of hydrogen peroxide with other useful products is also described in the prior art. Eng et al in U.S. Pat. No. 3,884,777 show the simultaneous generation of chlorine dioxide, hydrogen peroxide, sodium hydroxide and chlorine in a three compartment electrochemical cell. In this case the peroxide is obtained by anodic oxidation of sulphuric acid.

The simultaneous electrosynthesis of alkaline peroxide and chlorine or sodium chlorate is disclosed by Hideo Yamamoto in Japanese patent 61-284591.(app June 10 1985). Yamamoto describes a divided electrochemical cell with a graphite cathode and noble metal anode. The separator may be a porous diaphragm (which permits the passage of ions and convective flow in both directions) but the examples in the patent use only a cation exchange membrane such as Nafion 315 of duPont. An alkaline peroxide solution is produced in the cathode chamber by the reduction of oxygen in the presence of an organic agent such as a quinone. The organic redox agent can be either dissolved in the cathloyte or coated on the cathode. Chlorine is produced simultaneously at the anode from a solution of sodium chloride. Alternatively, sodium chlorate may be produced in the anode chamber by addition of sodium hydroxide to the anolyte to control its pH around 6.5, to 7.0, in which case Yamamoto must add the complete stoichiometric amount of sodium hydroxide required to neutralize the chlorine generated by the anode. Yamamoto suggests that the sodium hydroxide used to control the pH of the anolyte may be obtained by separating it from the catholyte product by dialysis through an anion exchange membrane but no examples are given for this part of the process. In fact, in his Example 3, Yamamoto adds sodium hydroxide from a separate source.

SUMMARY OF THE INVENTION

In one aspect, the invention pertains to a process for the simultaneous electrosynthesis of alkaline peroxide and oxygenated halogen salts of alkali metals which consists of:

(a) passing an aqueous alkali metal hydroxide solution together with oxygen through the cathode chamber of an electrochemical reactor where the cathode and anode chambers are separated by an anion permeable wall;

(b) passing an aqueous alkali metal halide salt solution through the anode chamber as an anolyte; and (c) passing direct electric current between the cathode and anode to convert the oxygen to alkaline peroxide at the cathode and the alkali metal halide salt to an oxygenated halogen salt of an alkali metal in the anolyte.

In the process, the anion permeable wall can be an anion exchange membrane. In the process, the halide may be chloride, bromide or iodide and the oxygenated halogen salt of an alkali metal can be a hypobromite, hypochorite, hypo iodate, bromate, chlorate, iodate, or perbromate perchlorate or periodate. Specifically, in the process, the hydroxide can be sodium hydroxide, the halide can be sodium chloride and the oxygenated halogen salt of an alkali metal can be sodium chlorate or sodium hypo chlorite. In the process, the oxygen can be fed to the reactor as a gas.

In the process, the anolyte can be passed through an external thermochemical reactor and recycled to the anode chamber of the electrochemical reactor. The pH of the recycling anolyte can be controlled by the addition of an acid such as hydrochloric acid or a suitable base as required.

In another aspect, the invention pertains to an electrochemical reactor for the simultaneous electrosynthesis of alkaline peroxide and oxygenated halogen salt of an alkali metal which consists of an anode and a cathode separated by an anion permeable wall.

In the reactor, the anion permeable wall can be an anion exchange membrane. The anion exchange membrane can be protected on the anode side by a porous diaphragm of material resistant to attack by halate or hypo-halite solutions. In the reactor, the cathode can be a porous matrix with a surface of suitable electrocatalyst for oxygen reduction to perhydroxide in alkaline solution. In the reactor, the cathode can be a bed of fibrous, particulate or reticulate graphite.

DRAWINGS

In the drawings which illustrate specific embodiments of the invention, but which should not be construed as restricting the spirit or scope of the invention in any way:

DETAILED DESCRIPTION OF SPECIFIC EMBODIMENTS OF THE INVENTION

The present invention is directed to achieving the simultaneous electrosynthesis of alkaline peroxide and oxygenated halogen salts of alkali metal solutions without the use of an organic redox agent or the need to recover hydroxide from the catholyte product in a separate process step. It is possible with the invention to produce chlorate at useful efficiency without contamination by chromate. With the invention, chlorate is produced in an electrochemical reactor with an oxygen depolarised cathode. The invention produces peroxide and chlorate at commercially useful concentrations and under commercially useful (i.e. economic) process conditions. The process of the invention can also be used to produce bromates or iodates by analogous anode reactions from bromides or iodides respectively. These reactions are well known to those skilled in the art of inorganic electrosynthesis.

Figure 1:
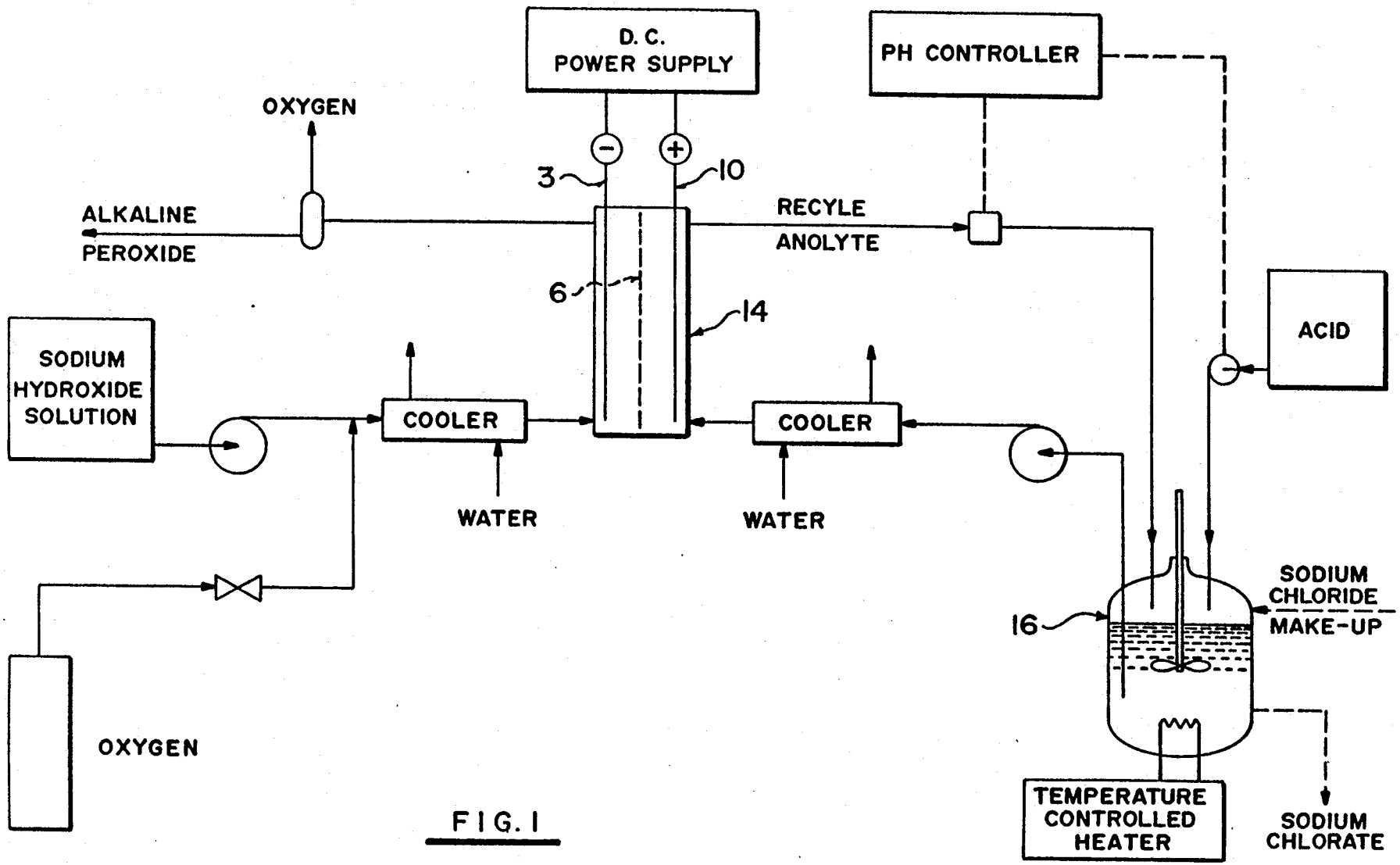
FIG. 1 illustrates a process for the simultaneous electrosynthesis of alkaline peroxide and sodium chlorate.

The apparatus employed to practise the process of the invention uses an oxygen reduction cathode and a halogen generating anode separated by an anion permeable wall [for example, an anion exchange membrane]. As shown in FIG. 1, oxygen and a hydroxide solution (e.g. sodium hydroxide in water) are fed to the cathode while a halide solution (e.g. sodium chloride in water) is fed to the anode. The oxygen is reduced directly on the cathode to hydroxide and perhydroxide according to the following equation:

$$O_2+H_2O+2e^-\rightarrow OH^-+HO_2 \quad (1)$$

Where the halogen is chlorine, choride is oxidised to chlorine on the anode according to equation (2).

$$2Cl^-\rightarrow Cl_2+2e^- \quad (2)$$

Hydroxyl and perhydroxyl anions are transported through the anion permeable separator from the cathode to the anode chamber. In the anode chamber the chlorine is hydrolysed to hypochlorite according to reactions (3) and (4) and this is subsequently converted to chlorate according to reaction (5) in an external thermochemical reactor which receives the recycling anolyte.

$$Cl_2+H_2O\rightarrow HOCl+HCl \quad (3)$$

$$HOCl+OH^-\rightarrow H_2O+OCl^- \quad (4)$$

$$2HOCl+OCl^-\rightarrow ClO_3^-+2HCl \quad (5)$$

Any perhydroxyl which crosses the membrane to the anode chamber most likely quickly destroys chlorine and hypochorite by reactions such as (6) and (7) below.

$$4HO_2^-+2Cl_2\rightarrow 4Cl^-+2H_2O+3O_2 \quad (6)$$

$$HO_2^-+OCl^-\rightarrow Cl^-+OH^-+O_2 \quad (7)$$

Similarly, any hypochlorite which crosses from the anode to the cathode chamber probably destroys peroxide according to reaction (7).

Figure 4:
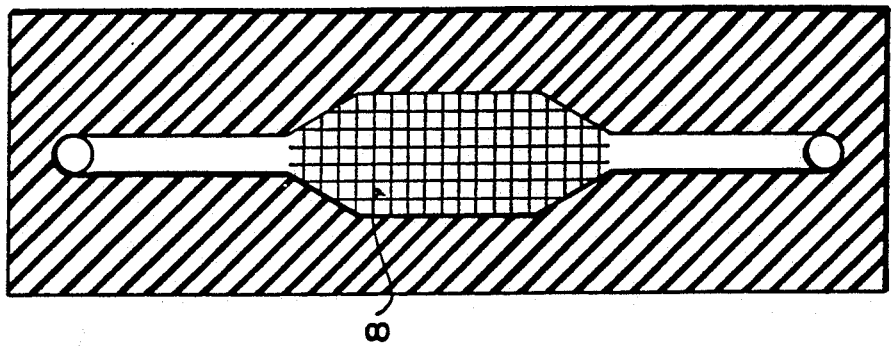
FIG. 4 illustrates a section view taken along section line B—B of the anode of the reactor illustrated in FIG. 2.
Figure 3:
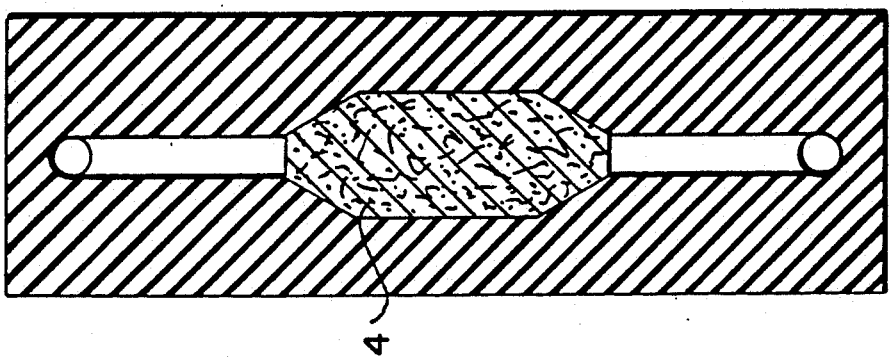
FIG. 3 illustrates a section view taken along section line A—A of the cathode of the reactor illustrated in FIG. 2.
Figure 2:
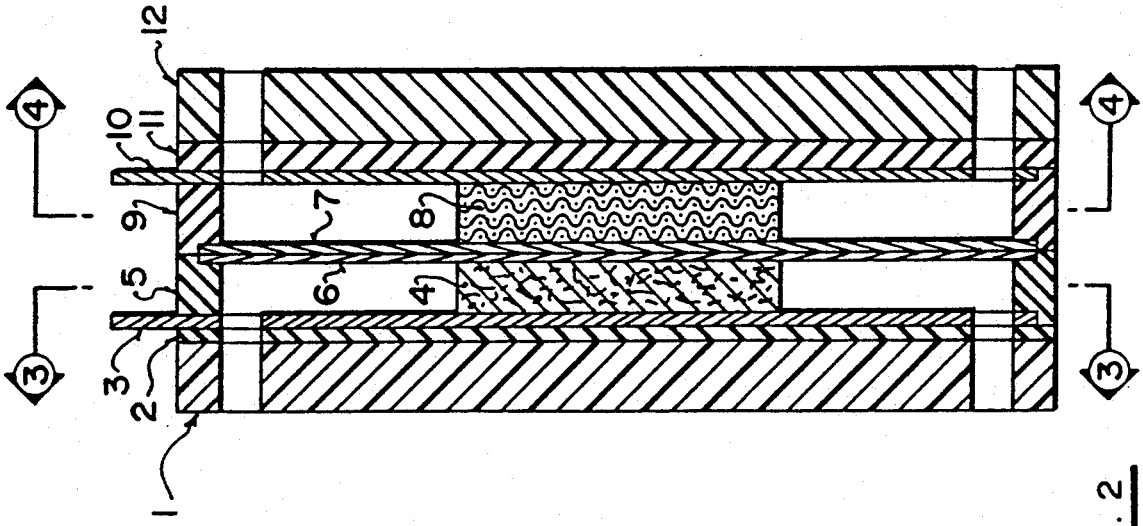
FIG. 2 illustrates side partial section view of an electrochemical reactor which can carry out the process.

A person skilled in the art would expect that reactions (6) and (7) would reduce current efficiency for both peroxide and chlorate or hypochlorite and seriously compromise the utility of the process. The extent of reactions (6) and (7) will depend on the selectivity of the anion membrane and the conditions of operation of the process. Data on the performance of such a process was not previously available but now we have found unexpectedly by experiment that this process is feasible. We have demonstrated by using a reactor as illustrated in FIGS. 2, 3 and 4 that it is possible to produce both metal chlorate and alkaline peroxide operating under commercially useful conditions of current density, temperature and product concentrations.

In principle it may be possible to carry out this process in a reactor were the separator is a simple porous diaphragm but it could not be done when the separator is a cation exchange membrane as used in Japanese patent 61-284591. A porous diaphragm allows anion transport but it does not prevent convective transport between the electrode chambers. We have conducted experiments with porous diaphragms as separators and have obtained poor results. The preferred separators for the process of this invention are anion exchange membranes. Anion exchange membranes essentially eliminate efficiency losses due to convection between the anode and cathode chambers. Anion membranes may also be advantageous because of their effect on ion diffusivity, which determines the relative rates of transport of the hydroxide, perhydroxide, hypohalite, halide and halate ions between electrode chambers.

To obtain good efficiency for chlorate production in this process, it is necessary to maintain the anolyte pH in the range of about 6 to 7. The transport of hydroxide and perhydroxide across the separator tends to drive up the anolyte pH and when chlorine is lost in vent gases from the anolyte loop, it is usually necessary to control pH by additions of acid (e.g. hydrochloric acid). Under some conditions (depending on operating conditions, membrane age and the manner of venting the anolyte loop), a small proportion of hydroxide may be needed to control the anolyte pH to about 6.7. This hydroxide is equivalent to less than 20% of the stoichiometric amount procedure is contrary to the method taught in Japanese patent 61-284591 which requires the addition of the total stoichiometric amount of hydroxide equivalent to the chlorine generated by the anode to maintain anolyte pH at about 6.7.

DETAILED DESCRIPTION OF THE PROCESS

The feasibility of the process of this invention has been demonstrated in the laboratory as illustrated in FIG. 1. FIG. 1 illustrates a continuous electrochemical process in which an aqueous hydroxide solution with oxygen (catholyte) and an aqueous chloride solution (anolyte) are pumped respectively through the cathode and anode chambers of an electrochemical reactor. The catholyte passes through a cooler and then makes a single pass through the electrochemical reactor. The anolyte is recycled to the electrochemical reactor through an external thermochemical reactor with heat exchangers to control the anolyte temperature. The pH of the recyling anolyte is automatically controlled to about 6.5 by the addition of hydrochloric acid or by sodium hydroxide.

Catholyte and anolyte may pass through the reactor in either cocurrent or countercurrent flow relative to each other. When direct electric current is applied to the reactor, perhydroxide is generated in the catholyte and chlorate accumulates in the anolyte.

For commercial purposes the chlorate would be purged from the anolyte loop when it reached a required concentration and would be replaced by a make-up of chloride. Water would be added or removed from the loop to control the water balance.

In the laboratory experiments that we have conducted, the catholyte was a two-phase mixture consisting of an aqueous solution of sodium hydroxide and gaseous oxygen. The anolyte was an aqueous solution of sodium chloride and sodium chlorate. The chlorate concentration was varied for different experiments.

The electrochemical reactor design (as illustrated in FIG. 2, 3 and 4) is critical to the success of this process. The two most important features of the electrochemical reactor are the anion exchange membrane used as the cell separator and the porous cathode used to obtain good efficiency for peroxide generation at high superficial current densities. FIG. 2, 3 and 4 show in detail the construction of the reactor that we have used in our experiments.

The components of the reactor are itemized as follows:

ITEM

1. Plastic (plexiglass) compression plate containing the inlet and outlet ports for catholyte.
2. Elastomer gasket to prevent leaks between compression plate [1] and current feeder [3].
3. Feeder electrode constructed of 0.5 mm thick 304 stainless steel plate to distribute current to the porous cathode.
4. Cathode bed of graphite fibre felt 230 mm high by 36 mm wide by 3 mm thick. The thickness and porosity of the cathode bed are fixed by compressing a ¼ inch felt into a channel cut in the 3 mm neoprene gasket (item 5). The graphite felt for the cathode was obtained from the Carborundum Corporation.
5. Elastomer (neoprene) gasket defining the catholyte flow path and cathode dimensions.
6. Anion exchange membrane used to separate the cathode chamber from the anode chamber. The anion membrane was type R-1035 obtained from RAI Corporation.
7. Asbestos paper about 0.5 mm thick used to protect the anion membrane from chemical attack by the anolyte.
8. Anode chamber 230 mm high by 36 mm wide by 3 mm thick containing several layers of approximately 10 mesh PVC plastic screen for membrane support.
9. Elastomer gasket (neoprene) defining the anolyte flow path and anode dimensions.
10. Anode plate. 2 mm thick titanium coated with a mixture of noble metal oxides. The anode plate was a chlorine DSA anode obtained from the Electrode Corporation.
11. Elastomer gasket to prevent leaks between compression plate (12) and anode plate (10).
12. Plastic (plexiglass) compression plate containing inlet and outlet ports for anolyte.

The appropriate holes are cut in the plates and gaskets and fittings are supplied to allow flow of catholyte and anolyte through the respective chambers.

In our experiments, the porous cathode was operated as a trickle-bed with two-phase cocurrent flow of the liquid hydroxide solution and oxygen gas as described by Oloman and Watkinson in U.S. Pat. No. 4,118,305.

The external thermochemical reactor was a glass vessel of about 2 liters volume.

EXAMPLES 1 TO 4

The process of FIG. 1 with the reactor of FIGS. 2, 3 and 4 was operated in the laboratory under a range of conditions to produce alkaline peroxide and sodium chlorate solutions. Each run was carried out for a period of several hours and the chlorate efficiency was determined by measuring the amount of chlorate accumulated in the anolyte during the run.

The conditions of eight demonstrative example runs are summarised in Tables 1 and 2. Table 1 concerns runs where the thermochemical reactor was vented to the atmosphere and the recycling anolyte was delivered above the liquid surface in the thermochemical reactor (as in FIG. 1). Table 2 concerns later runs where chlorine losses from the anolyte were suppressed by delivering the recycle anolyte beneath the liquid surface in the thermochemical reactor.

The runs reported in Table 1 were carried out with the electrochemical reactor as described above over operating periods from 2 to 4 hours. For the runs in Table 2, the asbestos diaphragm (item 7) was removed from the electrochemical reactor and the operating period extended to 8 hours per run.

TABLE 1

| | Simultaneous electrosynthesis of peroxide and chlorate | | | | | | | |
|---|---|---|---|---|---|---|---|---|
| | Catholyte Feed | | Anolyte | | | Peroxide Chlorate Product | | |
| | | | NaCl | NaClO3 | Current | | | |
| Example | NaOH m | Flow ml/s | M average | M range | density kA/m2 | H2O2 M | CE % | CE % |

TABLE 1-continued

| | | | | | | | | |
|---|---|---|---|---|---|---|---|---|
| 1 | 0.5 | 0.5 | 3.8 | 0.23–0.37 | 2.4 | 0.08 | 39 | 78 |
| 2 | 2.0 | 0.1 | 3.8 | 0.00–0.03 | 1.2 | 0.45 | 86 | 53 |
| 3 | 2.0 | 0.5 | 2.8 | 2.72–2.79 | 1.2 | 0.10 | 97 | 67 |
| 4 | 2.0 | 0.1 | 2.8 | 2.89–3.02 | 2.4 | 0.81 | 78 | 73 |

CE = current efficiency
Other conditions were held constant for Examples 1 to 4
Membrane age in use for each run - about 3 to 20 hours
Superficial electroactive anode area - 0.0083 m2
Period of operation for each run - about 3 hours
Temperature in thermochemical reactor - 70 +/− 2 deg. C.
pH in thermochemical reactor - controlled by addition of hydrochloric acid - 6.5
Volume of anolyte in thermochemical reactor - 2 +/− 0.2 liter
Note that the chlorate concentrations above are normalised to a constant anolyte volume of 2 liters to account for the small increase in anolyte volume which occurred in each run.

| Electrochemical reactor | Anode side | Cathode side | |
|---|---|---|---|
| Temperature | 27 to 33 | 22 to 30 | deg C. |
| Pressure | 60 to 0 | 45 to 0 | kPa gauge |
| Oxygen flow | 0 | 8.5 | cm3/s STP |
| Anolyte flow | 2 | — | cm3/s |

Approximate voltage at 1.2 kA/m2 = 3.0 V at 2.4 kA/m2 = 4.2 V

TABLE 2

Simultaneous electrosynthesis of peroxide and chlorate

| | Anolyte | | | | Current density | Product | | | pH cont. | Membrane |
|---|---|---|---|---|---|---|---|---|---|---|
| | Temp. | Volume | NaCl | NaClO3 | and Volts | Peroxide | Chlorate | | NaOH | time in |
| Example | C. *in/out | liter I/F | M I/F | M I/F | kA/m2 volts | H2O2 M | CE % | CE % | total moles | use hours |
| 5 | 25 | 1.610 | 2.54 | 2.55 | 1.8 | 0.21 | 70 | 68 | 0.55 | 24 |
| | 30 | 2.095 | 1.64 | 2.20 | 4.5 | | | | | |
| 6 | 63 | 1.605 | 2.50 | 3.22 | 1.8 | 0.24 | 80 | 35 | 0.44 | 8 |
| | 62 | 2.153 | 1.62 | 2.52 | 3.5 | | | | | |
| 7 | 63 | 1.560 | 2.50 | 3.00 | 1.8 | 0.25 | 77 | 38 | 0.92 | 24 |
| | 62 | 2.416 | 1.30 | 2.02 | 3.5 | | | | | |
| 8 | 62 | 1.667 | 2.30 | 2.87 | 2.4 | 0.29 | 64 | 41 | 0.28 | 8 |
| | 61 | 1.875 | 1.62 | 2.77 | 3.7 | | | | | |

CE = current efficiency based on 6 Faraday/mole chlorate 2 Faraday/mole peroxide.
I/F = initial (at 0 hours) and final (at 8 hours) values for each run.
*in/out anolyte temperatures in electrochemical reactor.
Other conditions held constant for examples 5 to 8.
Superficial electroactive anode area - 0.0083 m2
Period of operation for each run - 8 hours
Temperature in thermochemical reactor - 70 +/= 2 deg. C.
pH in thermochemical reactor - 6.7 +/− 0.3 - controlled by addition of sodium hydroxide. Table 2 shows total moles used in 8 hour run.
Volume of anolyte in thermochemical reactor - as in table

| Electrochemical reactor | Anode Side | Cathode Side | |
|---|---|---|---|
| temperature | as in table | 22 to 35 | deg C. |
| pressure | 100 to 0 | 35 to 0 | kPa gauge |
| inlet oxyen flow | 0 | 8.5 | cm3/s STP |
| anolyte flow | 3 | — | cm3/s |
| catholyte flow | — | 0.25 | cm3/s |

Tables 1 and 2 show some sets of conditions which indicate the potential commercial use of the process. Many other sets of conditions are possible and considered within the scope of the invention. For example, the electrochemical reactor could be operated at pressures of several atmospheres, temperatures below 22° C. or above 33° C., sodium hydroxide concentrations below 0.5 M or above 2M, oxygen flow above or below 8.5 cm3/s STP, current density below 1.2 or above 2.4 kA/m2, etc.

Feasible ranges of conditions for operation of the electrochemical reactor are approximately as follows:

Temperature 0 to 100° C.
Sodium hydroxide concentration 0.1 to 5 m
Oxygen Flow 0.1 to 3 $cm^3/5cm^2$
Current Density 0.1 to 6 kA/m3
Pressure 0 to 1000 kPa gauge
Sodium chloride concentration 0.1 to 5 m
Sodium chlorate concentration 0.1 to 5 m
Temperature (thermochemical reactor) 20° to 100° C.

A major potential problem with the process of the invention is the loss of chloride, chlorate or hypochorite from the anolyte by leakage through the membrane into the catholyte. Our experimental measurements of the chloride balance in the process show some loss of chlorine species to the catholyte but our measurements do not indicate that this is a serious problem. Another potential problem is the deterioration of the membrane after extended use. With asbestos paper protecting the membrane, our experiments detected little membrane deterioration in 20 hours of operation.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A process for the simultaneous electrosynthesis of alkaline peroxide and oxygenated halogen salts of alkali metals which comprises:

(a) passing an aqueous alkali metal hydroxide solution together with oxygen through the cathode chamber of an electrochemical reactor where the cathode and anode chambers are separated by an anion permeable wall;

(b) passing an aqueous alkali metal halide salt solution through the anode chamber as an anolyte; and (c) passing direct electric current between the cathode and anode to convert the oxygen to alkaline peroxide at the cathode and the alkali metal halide salt to an oxygenated halogen salt of an alkali metal in the anolyte.

2. A process according to claim 1 wherein an anion permeable wall is an anion exchange membrane.

3. A process according to claim 1 wherein the alkali metal halide salt is a chloride, bromide or iodide salt and the oxygenated halogen salt of an alkali metal is a hypochlorite, hypobromite, hypoiodate, chlorate, bromate, iodate, perchlorate, perbromate or periodate salt.

4. A process according to claim 1 wherein the alkali metal hydroxide is sodium hydroxide, the alkali metal halide salt is sodium chloride and the oxygenated halogen salt of an alkali metal is sodium chlorate.

5. A process according to claim 1 wherein the anolyte is passed through an external thermochemical reactor and is recycled to the anode chamber of the electrochemical reactor.

6. A process according to claim 5 wherein the pH of the recycling anolyte is controlled by the addition of an acid or base.

7. A process according to claim 5 wherein the pH of the recycling anolyte is controlled by addition of hydrochloric acid or sodium hydroxide.

8. A process for the simultaneous electrosynthesis of alkaline peroxide and oxygenated halogen salts of alkali metals which comprises:

(a) passing an aqueous alkali metal hydroxide solution together with gaseous oxygen through the cathode chamber of an electrochemical reactor where the cathode and anode chambers are separated by an anion permeable wall;

(b) passing an aqueous alkali metal halide salt solution through the anode chamber as an anolyte; and (c) passing direct electric current between the cathode and anode to convert the oxygen to alkaline peroxide at the cathode and the alkali metal halide salt to an oxygenated halogen salt of an alkali metal in the anolyte.

* * * * *